US008662500B2

(12) United States Patent
Swanson

(10) Patent No.: US 8,662,500 B2
(45) **Date of Patent: *Mar. 4, 2014**

(54) CARD WEIGHT FOR GRAVITY FEED INPUT FOR PLAYING CARD SHUFFLER

(71) Applicant: SHFL entertainment, Inc., Las Vegas, NV (US)

(72) Inventor: Ronald R. Swanson, Otsego, MN (US)

(73) Assignee: SHFL Entertainment, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/741,236

(22) Filed: Jan. 14, 2013

(65) Prior Publication Data

US 2013/0134674 A1 May 30, 2013

Related U.S. Application Data

(63) Continuation of application No. 11/444,167, filed on May 31, 2006, now Pat. No. 8,353,513.

(51) Int. Cl.
*A63F 1/12* (2006.01)

(52) U.S. Cl.
USPC ..... 273/149 R

(58) Field of Classification Search
None
See application file for complete search history.

(56) References Cited

U.S. PATENT DOCUMENTS

| | | | |
|---|---|---|---|
| 793,489 | A | 6/1905 | Williams |
| 1,014,219 | A | 1/1912 | Hall |
| 1,885,276 | A | 11/1932 | McKay |
| 2,001,220 | A | 5/1935 | Smith |

(Continued)

FOREIGN PATENT DOCUMENTS

| | | |
|---|---|---|
| WO | 87/00764 | 2/1987 |
| WO | 98/40136 | 9/1998 |
| WO | 00/51076 | 8/2000 |

OTHER PUBLICATIONS

Scarne's Encyclopedia of Games by John Scarne, 1973, "Super Contract Bridge", p. 153.

(Continued)

*Primary Examiner* — Kurt Fernstrom
*Assistant Examiner* — Dolores Collins
(74) *Attorney, Agent, or Firm* — TraskBritt

(57) ABSTRACT

A card-feeding device for feeding cards into a card-handling device is disclosed. Examples of card-handling devices include shufflers, card sorters, card delivery devices and card verification devices. The device includes a card infeed area that supports a stack of cards. The card infeed area has a card support surface. Included in the device is a card-removing system that removes cards individually from the bottom of the stack. A pivoting arm presses against a card at the top of the stack. At least one sensor is provided that detects at least one of a position of the arm and a presence of a card in the card infeed area. A method of shuffling cards is also disclosed. The method includes the steps of providing cards to be shuffled into a card infeed area as a stack with a top and bottom and removing cards one at a time from the bottom of the stack and moving the removed cards to a shuffling zone. Cards are then shuffled. The stack of cards is stabilized by a pivoting arm capable of pressing against the top of the stack in an engaged position. The pivot arm may be automatically rotated from a first card-engaging position to a second recessed position.

19 Claims, 2 Drawing Sheets

(56) References Cited

U.S. PATENT DOCUMENTS 2,001,918 A 5/1935 Nevius
2,016,030 A 10/1935 Woodruff et al.
2,043,343 A 6/1936 Warner
2,065,824 A 12/1936 Plass
2,254,484 A 9/1941 Hutchins
2,328,153 A 8/1943 Laing
2,328,879 A 9/1943 Isaacson
2,364,413 A 12/1944 Wittel
2,778,644 A 1/1957 Stephenson
2,937,739 A 5/1960 Levy
2,950,005 A 8/1960 MacDonald
3,147,978 A 9/1964 Sjostrand
3,235,741 A 2/1966 Plaisance
3,312,473 A 4/1967 Friedman et al.
3,530,968 A 9/1970 Palmer
3,595,388 A 7/1971 Castaldi
3,690,670 A 9/1972 Cassady et al.
3,716,238 A 2/1973 Porter
3,897,954 A 8/1975 Erickson
3,944,230 A 3/1976 Fineman
4,159,581 A 7/1979 Lichtenberg
4,232,861 A 11/1980 Maul
4,310,160 A * 1/1982 Willette et al. ..... 273/149 R
4,361,393 A 11/1982 Noto
4,368,972 A 1/1983 Naramore
4,385,827 A 5/1983 Naramore
4,388,994 A 6/1983 Suda et al.
4,397,469 A 8/1983 Carter
4,494,197 A 1/1985 Troy et al.
4,497,488 A 2/1985 Plevyak et al.
4,512,580 A 4/1985 Matviak
4,513,969 A 4/1985 Samsel
4,515,367 A 5/1985 Howard
4,534,562 A 8/1985 Cuff et al.
4,566,782 A 1/1986 Britt et al.
4,586,712 A 5/1986 Lorber et al.
4,659,082 A 4/1987 Greenberg
4,662,637 A 5/1987 Pfeiffer et al.
4,667,959 A 5/1987 Pfeiffer et al.
4,741,524 A 5/1988 Bromage
4,750,743 A 6/1988 Nicoletti
4,755,941 A 7/1988 Bacchi
4,759,448 A 7/1988 Kawabata
4,770,421 A 9/1988 Hoffman
4,807,884 A * 2/1989 Breeding ..... 273/149 R
4,822,050 A 4/1989 Normand et al.
4,832,342 A * 5/1989 Plevyak et al. ..... 273/149 R
4,876,000 A 10/1989 Mikhail et al.
4,900,009 A 2/1990 Kitahara et al.
4,926,327 A 5/1990 Sidley
4,951,950 A 8/1990 Normand et al.
4,969,648 A 11/1990 Hollinger et al.
4,995,615 A 2/1991 Cheng et al.
5,000,453 A 3/1991 Stevens et al.
5,067,713 A 11/1991 Soules et al.
5,081,487 A 1/1992 Hoyer et al.
5,121,192 A 6/1992 Kazui
5,121,921 A 6/1992 Friedman
5,179,517 A 1/1993 Sarbin et al.
5,199,710 A 4/1993 Lamle
5,209,476 A 5/1993 Eiba et al.
5,224,712 A 7/1993 Laughlin et al.
5,240,140 A 8/1993 Huen
5,257,179 A 10/1993 DeMar et al.
5,261,667 A 11/1993 Breeding
5,275,411 A 1/1994 Breeding
5,276,312 A 1/1994 McCarthy et al.
5,283,422 A 2/1994 Storch et al.
5,288,081 A 2/1994 Breeding et al.
5,299,089 A 3/1994 Lwee
5,303,921 A * 4/1994 Breeding ..... 273/149 R
5,356,145 A * 10/1994 Verschoor ..... 273/149 R
5,362,053 A 11/1994 Miller et al.
5,374,061 A 12/1994 Albrecht et al.
5,382,024 A 1/1995 Blaha
5,382,025 A 1/1995 Sklansky et al.
5,390,910 A 2/1995 Mandel
5,431,399 A 7/1995 Kelley et al.
5,437,462 A 8/1995 Breeding et al.
5,445,377 A * 8/1995 Steinbach ..... 273/149 R
5,470,079 A 11/1995 LeStrange et al.
5,584,483 A 12/1996 Sines et al.
5,586,766 A 12/1996 Forte et al.
5,586,936 A 12/1996 Bennett et al.
5,605,334 A 2/1997 McCrea et al.
5,613,912 A 3/1997 Slater et al.
5,651,548 A 7/1997 French et al.
5,655,961 A 8/1997 Acres et al.
5,669,816 A 9/1997 Garczynski et al.
5,676,372 A 10/1997 Sines et al.
5,681,039 A 10/1997 Miller et al.
5,683,085 A 11/1997 Johnson et al.
5,690,324 A 11/1997 Otomo et al.
5,692,748 A * 12/1997 Frisco et al. ..... 273/149 R
5,695,189 A 12/1997 Breeding et al.
5,707,287 A 1/1998 McCrea et al.
5,718,427 A 2/1998 Cranford et al.
5,722,893 A 3/1998 Hill et al.
5,735,525 A 4/1998 McCrea et al.
5,735,742 A 4/1998 French et al.
5,772,505 A 6/1998 Garczynski et al.
5,779,546 A 7/1998 Meissner et al.
5,781,647 A 7/1998 Fishbine et al.
5,788,574 A 8/1998 Ornstein et al.
5,803,808 A 9/1998 Strisower
5,836,775 A 11/1998 Hiyama et al.
5,911,626 A 6/1999 McCrea et al.
5,919,090 A 7/1999 Mothwurf
5,936,222 A 8/1999 Korsunsky et al.
5,941,769 A 8/1999 Order et al.
5,944,310 A 8/1999 Johnson et al.
D414,527 S 9/1999 Tedham
5,989,122 A 11/1999 Roblejo et al.
6,015,311 A 1/2000 Benjamin et al.
6,019,368 A 2/2000 Sines et al.
6,039,650 A 3/2000 Hill et al.
6,068,258 A 5/2000 Breeding et al.
6,071,190 A 6/2000 Weiss et al.
6,093,103 A 7/2000 McCrea et al.
6,117,012 A 9/2000 McCrea et al.
6,126,166 A 10/2000 Lorson et al.
6,127,447 A 10/2000 Mitry et al.
6,139,014 A 10/2000 Breeding et al.
6,149,154 A 11/2000 Grauzer et al.
6,165,069 A 12/2000 Sines et al.
6,165,072 A 12/2000 Davis et al.
6,213,310 B1 4/2001 Wennersten et al.
6,217,447 B1 4/2001 Lofink et al.
6,250,632 B1 6/2001 Albrecht
6,254,096 B1 7/2001 Grauzer et al.
6,254,484 B1 7/2001 McCrea, Jr.
6,267,248 B1 7/2001 Johnson et al.
6,267,648 B1 7/2001 Katayama et al.
6,267,671 B1 7/2001 Hogan
6,270,404 B2 8/2001 Sines et al.
6,293,864 B1 9/2001 Romero
6,299,167 B1 10/2001 Sines et al.
6,299,536 B1 10/2001 Hill
6,313,871 B1 11/2001 Schubert
6,325,373 B1 12/2001 Breeding et al.
6,346,044 B1 2/2002 McCrea, Jr.
6,361,044 B1 3/2002 Block et al.
6,403,908 B2 6/2002 Stardust et al.
6,443,839 B2 9/2002 Stockdale et al.
6,446,864 B1 9/2002 Kim et al.
6,460,848 B1 10/2002 Soltys et al.
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.

(56) References Cited

U.S. PATENT DOCUMENTS

| | | | | |
|---|---|---|---|---|
| 6,533,662 | B2 | 3/2003 | Soltys et al. | |
| 6,568,678 | B2 | 5/2003 | Breeding et al. | |
| 6,579,180 | B2 | 6/2003 | Soltys et al. | |
| 6,579,181 | B2 | 6/2003 | Soltys et al. | |
| 6,582,301 | B2 | 6/2003 | Hill | |
| 6,582,302 | B2 | 6/2003 | Romero | |
| 6,585,586 | B1 | 7/2003 | Romero | |
| 6,585,856 | B2 | 7/2003 | Zwick et al. | |
| 6,588,750 | B1 | 7/2003 | Grauzer et al. | |
| 6,588,751 | B1 | 7/2003 | Grauzer et al. | |
| 6,595,857 | B2 | 7/2003 | Soltys et al. | |
| 6,616,535 | B1 | 9/2003 | Nishizaki et al. | |
| 6,622,185 | B1 | 9/2003 | Johnson | |
| 6,629,889 | B2 | 10/2003 | Mothwurf | |
| 6,629,894 | B1 | 10/2003 | Purton | |
| 6,637,622 | B1 | 10/2003 | Robinson | |
| 6,638,161 | B2 | 10/2003 | Soltys et al. | |
| 6,645,068 | B1 | 11/2003 | Kelly et al. | |
| 6,645,077 | B2 | 11/2003 | Rowe | |
| 6,651,981 | B2 * | 11/2003 | Grauzer et al. | 273/149 R |
| 6,651,982 | B2 * | 11/2003 | Grauzer et al. | 273/149 R |
| 6,652,379 | B2 | 11/2003 | Soltys et al. | |
| 6,655,684 | B2 | 12/2003 | Grauzer et al. | |
| 6,659,460 | B2 | 12/2003 | Blaha et al. | |
| 6,663,490 | B2 | 12/2003 | Soltys et al. | |
| 6,666,768 | B1 | 12/2003 | Akers | |
| 6,676,127 | B2 | 1/2004 | Johnson et al. | |
| 6,676,517 | B2 | 1/2004 | Beavers | |
| 6,680,843 | B2 | 1/2004 | Farrow et al. | |
| 6,685,567 | B2 | 2/2004 | Cockerille et al. | |
| 6,685,568 | B2 | 2/2004 | Soltys et al. | |
| 6,688,979 | B2 | 2/2004 | Soltys et al. | |
| 6,698,756 | B1 | 3/2004 | Baker et al. | |
| 6,712,696 | B2 | 3/2004 | Soltys et al. | |
| 6,719,634 | B2 | 4/2004 | Mishina et al. | |
| 6,726,205 | B1 | 4/2004 | Purton | |
| 6,732,067 | B1 | 5/2004 | Powderly | |
| 6,746,333 | B1 | 6/2004 | Onda et al. | |
| 6,758,751 | B2 | 7/2004 | Soltys et al. | |
| 6,758,757 | B2 | 7/2004 | Luciano, Jr. et al. | |
| 6,804,763 | B1 | 10/2004 | Stockdale et al. | |
| 6,848,844 | B2 | 2/2005 | McCue, Jr. et al. | |
| 6,886,829 | B2 | 5/2005 | Hessing et al. | |
| 6,889,979 | B2 | 5/2005 | Blaha | |
| 6,957,746 | B2 * | 10/2005 | Martin et al. | 221/131 |
| 6,959,925 | B1 | 11/2005 | Baker et al. | |
| 6,959,935 | B2 | 11/2005 | Buhl et al. | |
| 6,964,612 | B2 | 11/2005 | Soltys et al. | |
| 7,011,309 | B2 | 3/2006 | Soltys et al. | |
| 7,029,009 | B2 | 4/2006 | Grauzer et al. | |
| 7,036,818 | B2 | 5/2006 | Grauzer et al. | |
| 7,059,602 | B2 | 6/2006 | Grauzer et al. | |
| 7,066,464 | B2 * | 6/2006 | Blad et al. | 273/149 R |
| 7,073,791 | B2 | 7/2006 | Grauzer et al. | |
| 7,139,108 | B2 | 11/2006 | Andersen et al. | |
| 7,213,812 | B2 | 5/2007 | Schubert et al. | |
| 7,237,969 | B2 | 7/2007 | Bartman | |
| 7,255,344 | B2 | 8/2007 | Grauzer et al. | |
| 7,322,576 | B2 | 1/2008 | Grauzer et al. | |
| 7,338,044 | B2 | 3/2008 | Grauzer et al. | |
| 7,367,561 | B2 | 5/2008 | Blaha et al. | |
| 7,384,044 | B2 | 6/2008 | Grauzer et al. | |
| 7,413,191 | B2 | 8/2008 | Grauzer et al. | |
| 7,448,626 | B2 | 11/2008 | Fleckenstein | |
| 7,510,186 | B2 | 3/2009 | Fleckenstein | |
| 7,523,935 | B2 | 4/2009 | Grauzer et al. | |
| 7,661,676 | B2 * | 2/2010 | Smith et al. | 273/149 R |
| 7,766,332 | B2 * | 8/2010 | Grauzer et al. | 273/149 R |
| 8,353,513 | B2 | 1/2013 | Swanson | |
| 2001/0036231 | A1 | 11/2001 | Easwar et al. | |
| 2001/0036866 | A1 | 11/2001 | Stockdale et al. | |
| 2002/0107067 | A1 | 8/2002 | McGlone et al. | |
| 2002/0187830 | A1 | 12/2002 | Stockdale et al. | |
| 2003/0052450 | A1 | 3/2003 | Grauzer et al. | |
| 2003/0064798 | A1 | 4/2003 | Grauzer et al. | |
| 2003/0087694 | A1 | 5/2003 | Storch | |
| 2003/0090059 | A1 | 5/2003 | Grauzer et al. | |
| 2003/0094756 | A1 | 5/2003 | Grauzer et al. | |
| 2003/0195025 | A1 | 10/2003 | Hill | |
| 2004/0067789 | A1 | 4/2004 | Grauzer et al. | |
| 2004/0116179 | A1 | 6/2004 | Nicely et al. | |
| 2004/0224777 | A1 | 11/2004 | Smith et al. | |
| 2005/0035548 | A1 | 2/2005 | Yoseloff et al. | |
| 2005/0037843 | A1 | 2/2005 | Wells et al. | |
| 2005/0104290 | A1 | 5/2005 | Grauzer et al. | |
| 2005/0137005 | A1 | 6/2005 | Soltys et al. | |
| 2005/0146093 | A1 | 7/2005 | Grauzer et al. | |
| 2005/0206077 | A1 | 9/2005 | Grauzer et al. | |
| 2005/0242500 | A1 | 11/2005 | Downs | |
| 2006/0033269 | A1 | 2/2006 | Grauzer et al. | |
| 2006/0046853 | A1 | 3/2006 | Black | |
| 2006/0181022 | A1 | 8/2006 | Grauzer et al. | |
| 2006/0279040 | A1 | 12/2006 | Downs et al. | |
| 2007/0006708 | A1 | 1/2007 | Laakso | |
| 2007/0102879 | A1 | 5/2007 | Stasson | |
| 2007/0278739 | A1 | 12/2007 | Swanson | |
| 2008/0006997 | A1 | 1/2008 | Scheper et al. | |
| 2008/0113700 | A1 | 5/2008 | Czyzewski et al. | |
| 2008/0303210 | A1 | 12/2008 | Grauzer et al. | |
| 2009/0191933 | A1 | 7/2009 | French | |
| 2010/0244382 | A1 | 9/2010 | Snow | |
| 2010/0276880 | A1 | 11/2010 | Grauzer et al. | |
| 2011/0109042 | A1 | 5/2011 | Rynda et al. | |

OTHER PUBLICATIONS

Service Manual/User Manual for Single Deck Shufflers: BG1, BG2 and BG3 by Shuffle Master, 1997.

Specification of Australian Patent Application No. 31577/95, filed Jan. 17, 1995, Applicants: Rodney G. Johnson et al., Title: Card Handling Apparatus.

Specification of Australian Patent Application No. Not Listed, filed Aug. 15, 1994, Applicants: Rodney G. Johnson et al., Title: Card Handling Apparatus.

PCT International Search Report and Written Opinion of the International Searching Authority for PCT/US2008/007069, dated Sep. 8, 2008, 10 pages.

PCT International Search Report for PCT/US07/15035, dated Sep. 29, 2008, 3 pages.

PCT International Search Report for PCT/US07/15036, dated Sep. 23, 2008, 3 pages.

Press Release for Alliance Gaming Corp., Jul. 26, 2004—Alliance Gaming Announces Control with Galaxy Macau for New Mind Play Baccarat Table Technology, http://biz.yahoo.com/prnews.

Tracking the Tables, by Jack Bularsky, Casino Journal, May 2004, vol. 17, No. 5, pp. 44-47.

* cited by examiner

CARD WEIGHT FOR GRAVITY FEED INPUT FOR PLAYING CARD SHUFFLER

CROSS REFERENCE TO RELATED APPLICATIONS

This application is a continuation of U.S. patent application Ser. No. 11/444,167 filed May 31, 2006, now U.S. Pat. No. 8,353,513, issued Jan. 15, 2013.

BACKGROUND OF THE INVENTION

1. Field of the Invention

The present invention relates to playing card-feeding systems, particularly card-feeding systems for shuffling devices that may be used in a casino or card club environment, and particularly playing card-shuffling devices that use a gravity-feed system for providing playing cards from a playing card input chamber.

2. Background of the Art

In the movement of cards within playing card-handling devices, a typical card-feeding system may include pick-off roller(s) that are located on the bottom of stacks to remove one card at a time. The weight of a stack of cards ordinarily provides sufficient traction against the rollers to assure proper movement of most of the cards. But as the stack thins out after most of the cards have been delivered, the weight may no longer be sufficient (especially with the last few remaining cards in the stack) to assure proper movement of the cards.

U.S. Pat. No. 5,692,748 (Frisco) describes a card-shuffling device containing free-swinging weights on pivoting arms to apply pressure to the top of stacks of cards that are to be mixed. The disclosure, particularly that relating to FIGS. 4*b*-4*d*, states: "To assure traction between the wheels 48*a, b*, the circumference thereof has a coefficient friction to engage and pull a card, transport it and ejected it from the respective chutes 44*a, b* into the shaft 24. While preferably pairs of wheels 48*a, b* are used, it is to be understood that a single wheel or a cylinder could also be used as the tractive element. To impose a load on cards 30 deposited in the first and second chambers 34, 36 to assure traction with the wheels 48*a, b*, means are provided to vertically load the cards and urge them against the floors 40. For this purpose, each of the first and second chambers 34, 36 has an arm 52 pivotly mounted at one end by a pivot 54 to the housing 12 and having at the other end a foot 56. As described hereinafter, when cards are cut and deposited into the first and second chambers 34, 36, the arms 52 pivot as the cards 30 are urged over the front barriers 42 into their nested positions in the first and second chambers 34, 36. As nested on the floors 40 of the first and second chambers 34, 36, the arms remain in contact with the top of the cards 30 to impose a vertical load on the cards 30 to urge them to be contacted by the wheels 48*a, b*. Proximate the foot 56 of each aim 52, a weight 58 is provided on each of the arms 52. While a single arm 52 is shown it is to be understood that a pair of such arms 52 could be used at each of the chambers." These weights on pivoting arms apply pressure through the stack(s) of cards to assure traction against a pick-off roller at the bottom of the stack. This shows a pivoting weighted arm over the card infeed portions of a playing card shuffler.

U.S. Pat. Nos. 6,655,684; 6,588,751; 6,588,750; 6,568,678; 6,325,373; 6,254,096; 6,149,154; (Grauzer) and 6,139,014; 6,068,258; 5,695,189 (Breeding) describe a shuffler or card delivery shoe having a standard free-floating weight to provide increased force on the cards to keep them oriented and assist in their advancing. The Breeding references disclose sensors for detecting the presence of cards in a delivery tray or elsewhere.

U.S. Pat. No. 6,637,622 (Robinson) describes a card delivery device with a weighted roller assisting in allowing the cards to be easily removed. The weighted cover is on the delivery end of the dealing shoe, covering the next card to be delivered.

U.S. Pat. No. 5,722,893 (Hill) describes the use of a weighted block behind cards in a delivery shoe to provide additional weight on the cards to trigger sensors. The reference specifically states: "In operation, a wedge-shaped block mounted on a heavy stainless steel roller (not shown) in a first position indicates that no cards are in the shoe. When the cards are placed in the shoe, the wedge-shaped block will be placed behind the cards and it and the cards will press against the load switch.

U.S. Pat. No. 5,431,399 (Kelley) describes a bridge hand-forming device in which cards are placed into an infeed area and the cards are randomly or predeterminately distributed to four receiving trays. A weight is shown placed over the infeed cards.

In shufflers where there is a single stack of cards to be shuffled and the weight of the cards presses the lowermost cards into contact with card-moving elements such as pick-off rollers, friction contact plates, and the like, it has been suggested by the inventors that as the stack of cards diminishes and fewer cards are present to provide contact forces with the lowermost card-moving element, this failure of strong contact forces may be a cause for delivery failures in the last cards in a set of cards in the delivery chamber. It would be desirable to provide a mechanism that applies a force to gravity-fed cards to assure consistent feeding, yet have the capability of automatically retracting as to not interfere with card loading.

SUMMARY OF THE INVENTION

The present invention describes a moveable weight that is pivotally engaged with a frame of the card-feeding device to provide force against the top of the stack, even as the stack is lowered into the delivery chamber or input chamber of a shuffler. This moveable weight is provided in the form as a pivoting arm, and preferably a motor-driven pivoting arm with weighted roller to both press against the tops of the infeed stack of cards and to assist in sensing the absence of cards in the card infeed stack. In one form of the invention, the weighted arm is retractable.

The moveable weight may be pivotally attached at a point significantly below the elevation of the top of the stack of cards in the input chamber without potential damage to the cards. This reduces the height of the shuffling device and improves ergonomics for the dealer in not having to reach over the elevation of the pivoting device.

DETAILED DESCRIPTION OF THE INVENTION

Figure 1:
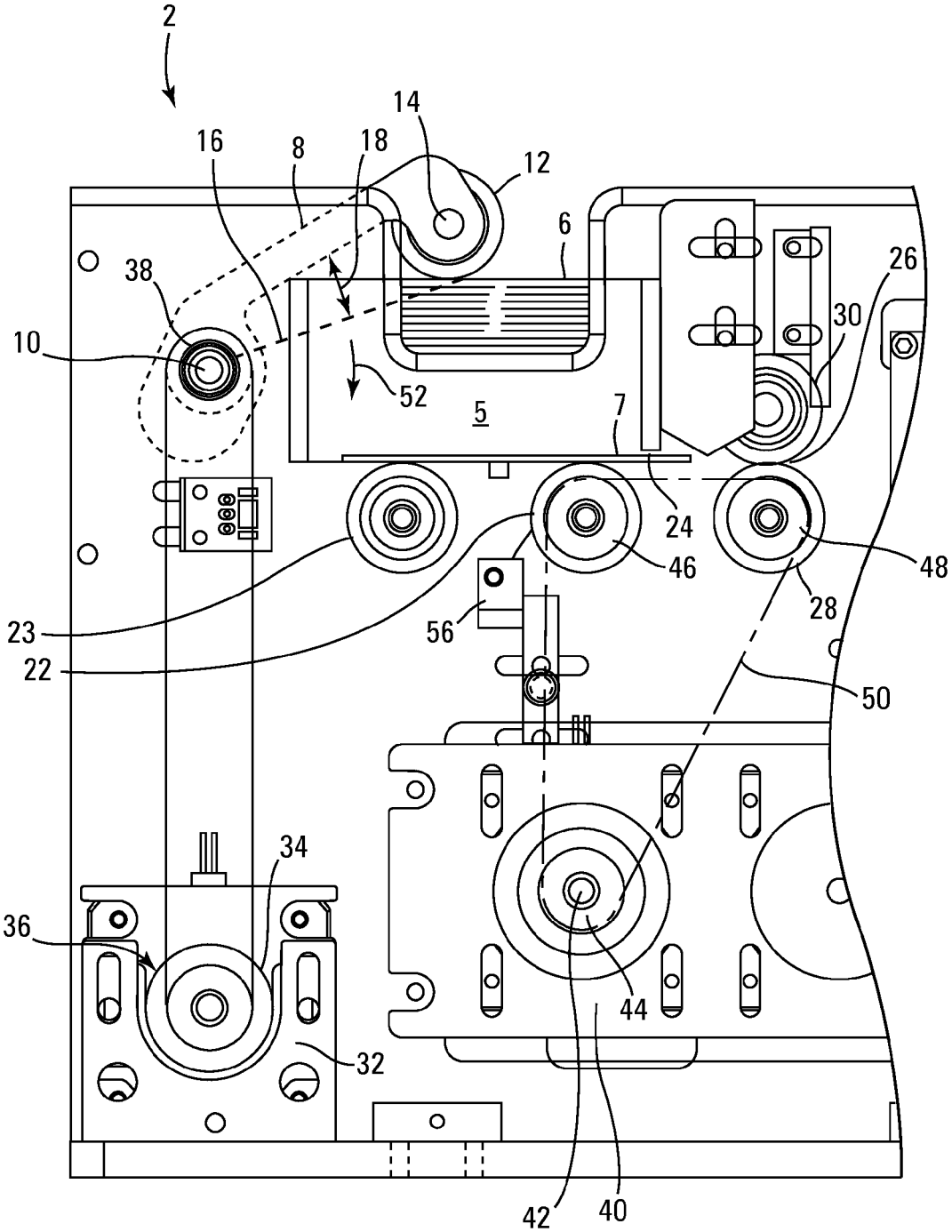
FIG. 1 shows a cutaway side elevational view of the input end of a gravity feed shuffling system that embodies one structure used in the practice of the technology described herein.

It is first to be noted that the presently described advance in technology is independent of the nature of the mechanism and format for actually shuffling the cards, but relates to the card input section of any shuffling machine where playing cards are fed one at a time from the bottom of a stack of playing cards. The stack of cards can rest on a substantially horizontal plane or can be positioned at an angle with respect to the horizontal. The shuffling mechanism could use card ejection technology, distribution of cards into an elevator stack of cards, distribution of cards into a circular carousel of compartments, distribution of cards into a fan array of compartments, distribution of cards into an opening created in a stack, or distribution into any array of compartments, etc.

In the practice of the described technology, a set of playing cards is usually placed as a stack or pile into a chamber. The cards are usually vertically stacked (with the face of each card being in a horizontal plane) within this type of chamber, but they may also be slightly angled (e.g., ±30 degrees from horizontal). The cards are stacked in the input chamber or card input area and then the cards are removed one at a time from the bottom of the set of cards. Preferably, the cards are placed with the face of the cards down, so that not even a single card is ever exposed, but this is not of functional importance to the practice of the present technology.

Typically, the bottommost playing card in the set of cards is the next playing card to be removed. Typically, as shown in the references described above, particularly some of the Grauzer et al. patents, a friction wheel (referred to as a pick-off roller) extends upwardly and into the bottom of the playing card input chamber, and rotation of the pick-off roller provides a driving force against the playing card, forcing the playing card out of the card input chamber and towards the shuffling area.

It is at this point in the shuffling machines where the thickness and mass of the set of cards in the input chamber varies as cards are removed, to the ultimate situation where there are just a few cards, then a single card and then no cards remaining in the chamber. When there are few cards or a single card remaining, the weight of the few cards or single card may be insufficient to retain efficient frictional contact with the pick-off roller, and the last cards may not be moved out of the input chamber when desired.

There are numerous independent elements of the technology described herein that provide advances over the existing technology and attempt to address these problems in a manner that does not create additional problems.

A first concept developed herein is the use of a pivoting weighted arm with a center of rotation of the pivoting arm that is below a point that is spaced above, and preferably at least 15 mm above the card support surface in the card-receiving chamber. The center of rotation may be located above the playing card support surface by at least 18 mm, at least 20 mm or at least 25 mm or more. Preferably, the pivot point is also spaced apart from the card infeed tray. The ability to provide this elevation of the pivot point of the arm in relation to the playing card surface allows for a lower height to the system, better consistency of weight against the cards, and the like. The relative elevation is provided by having an arm that extends above the rotation point on one end of the arm and also above the playing card contact point on the other end of the arm. This creates an elevated middle area or recess in the arm that can extend over the edge of the playing cards in the card input area to avoid contact with those cards.

A second concept developed herein is the use of a motor-driven arm that controls the height of the contact point and/or the force at the contact point and/or the retraction/lowering of the arm and/or other actions by the arm with respect to the loading, unloading and shuffling process, including addressing any card jam events.

Reference to the figures will assist in an understanding of the practice and scope of the technology described herein.

FIG. 1 shows a sectioned or cutaway side elevational view of the playing card-feeding portion 2 of a playing card-handling system. The height of a set of cards (e.g., a deck or decks of cards) 6 is shown in the playing card-receiving or input chamber 5. A pivoting arm 8 is shown with a roller 12 pivotally mounted about rotational shaft 14 at the contact end of the arm 8 resting on the top of the set of cards 6. This may represent a locked or controlled (as explained later) position of the arm 8. The arm 8 pivots about pivotal shaft 10 and the roller 12 pivots about pivotal shaft 14. A line 16 is shown between the rotation point 10 and the lower surface of the roller 12. As can be seen, this line intersects the height of the playing cards 6, which would mean that the traditional straight weighted arm (as shown by Frisco, above) would rest against the edge of the cards and possibly interfere with, damage or mark the cards. As is shown in FIG. 1, there is a significant gap 18 above the line 16 and the height of the set of playing cards 6 in the input chamber 5. This structure prevents the need for elevating the pivot point 10 of the arm 8 above the height of the uppermost card in the stack 6. When the arm and pivot point 10 have to be so elevated, the overall height of the shuffler is increased. Additionally, other functioning parts of the arm system, (i.e., the belts if used, drive wheels and the shaft, for example) may be exposed and subject to damage from the exposure.

A bottommost playing card 7 is driven by pick-off roller 22 through an outlet slot 24 in the bottom of the playing card input chamber 5. The playing card 7 driven though the slot 24 then engages rollers 28 and 30, which form a nip 26 that moves the playing card into the shuffling area of the shuffler (not shown). A motor 40 drives shaft 42. Shaft 42 rotates, causing sheaves 44, 46 and 48 to rotate. Endless member 50 contacts sheaves 44, 46 and 48.

Figure 2:
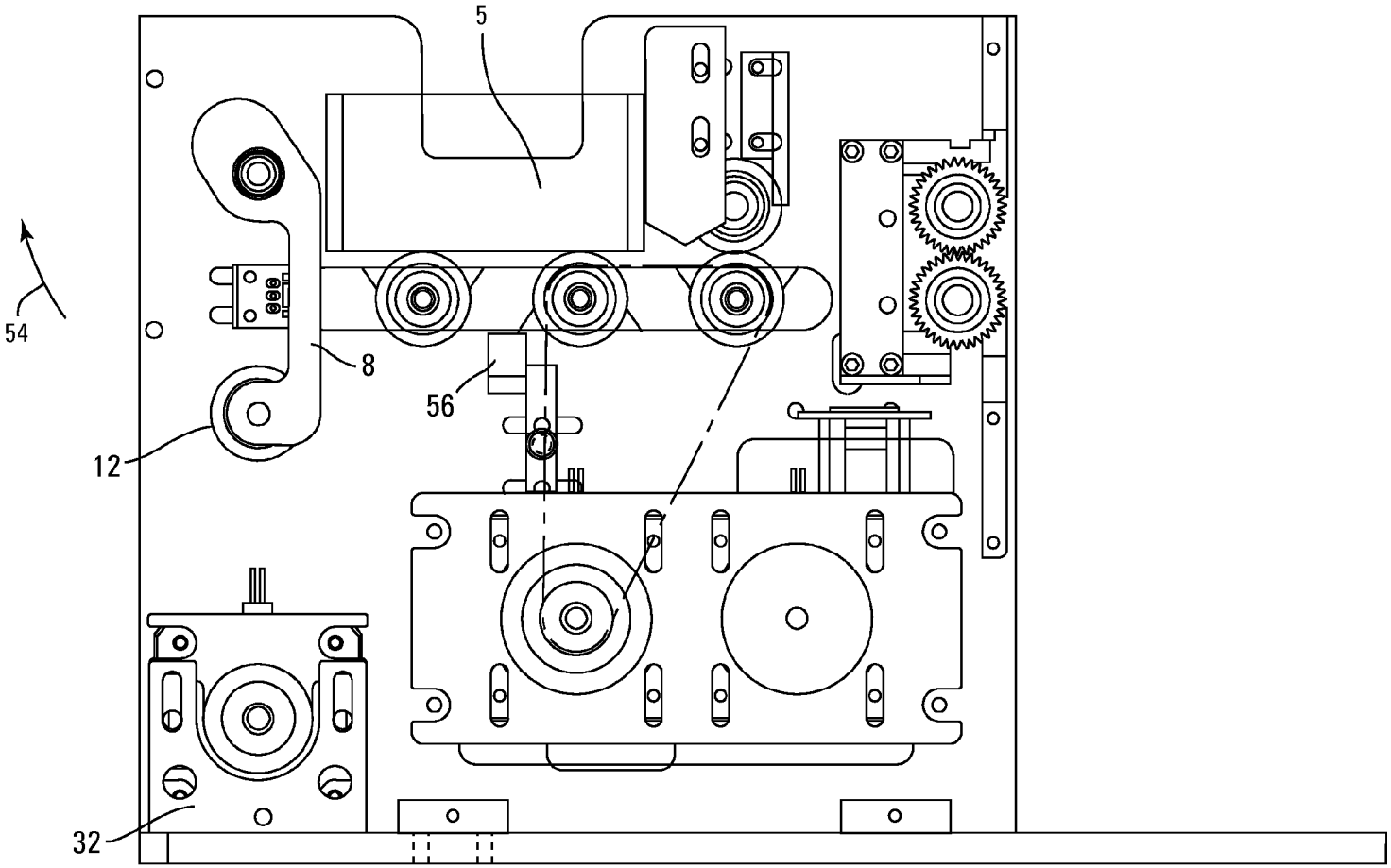
FIG. 2 shows a second side elevational view of an example of the present invention.

A stepper motor 32 is provided to drive a drive wheel 34 with drive belt 36 that also engages drive wheel 38, causing the weighted arm 8 to pivot. Once the last card exits the feed area 5, the pivot arm 8 rotates downwardly in a direction of arrow 52 into a retracted position. In the retracted position, as shown in FIG. 2, the pivot arm 8 is completely free of the card infeed area 5. Cards can be manually loaded without any interference from the pivot-mounted card weight 8.

After the next group of cards is inserted into the feed area 5, the pivot arm 8 continues to rotate in a clockwise direction as shown by arrow 54 until the wheel 12 comes back into contact with the top card in the next stack.

The card weight advantageously retracts and does not interfere with the loading of cards. A card present sensor 56 sends a signal to the processor (not shown) that in turn actuates motor 32 to rotate arm 8 into the "card engaged" position.

Operation of the arm may be controlled by a processor (not shown) and/or react to sensors or be free in its pivoting. When the arm has the spacing 18 built in, the arm may pivot and retain cards under its own weight. Because of the initial elevation of the arm (as shown by the angle of line 16 with respect to the horizontal), the arm will initially (under its own weight) pivot first towards the horizontal and then slightly below the horizontal. The contact point between the roller 12 and the top surface of the uppermost playing card will also move from a non-centered position towards a more centered position, as the height 6 of the uppermost playing cards changes. This orientation of the arm with a roller thereon reduces damage to the surface of the cards that is contacted by the roller.

When the arm is motor driven, an intelligent drive system (as with a processor, microprocessor or computer, with "processor" used generically) may assist in driving the positioning of the arm and apply contact pressure between the arm and the top of the set of playing cards in the card input chamber. The application of pressure can be accomplished a number of ways. For example, the processor may instruct the stepper motor to move a defined number of positions for each fed card.

One mode of operation of the intelligent drive system may include some or all of the following features. When no playing cards are present in the chamber (signals or data of which may be obtained from sensors or cameras), the processor may direct the arm to be rotated into a retracted position to facilitate depositing of the playing cards by hand. When the processor is provided with information such as signals or data indicating that playing cards are positioned in the input chamber 5, the arm is rotated (clockwise in FIG. 1) until contact is sufficiently made with the top of playing cards. This sensing may be accomplished in numerous ways, as with a contact sensor in the shaft 14, tension reduction sensed in the pulley 36 through the motor 34, cameras or optical sensors in the input chamber, and the like. Once contact is made, the arm may remain under tension by the drive system or become free in its rotating by disengaging gearing or pulleys driving the arm. Or upon removal of cards, the processor will adjust the tension in the pulley 36 to adjust the contact force of the roller 12 against playing cards. This adjustment may be done continually, periodically or at specific event occurrences, such as the movement of a single card, the movement of a specific number of cards out of the input chamber, or the like. The force applied by the roller to the top playing cards should usually be sufficient that removal of a single card from the bottom of the set of cards will not completely remove the force applied by the roller 12.

The system may also indicate the absence of playing cards in the input chamber. For example, sensor 56 may indicate that no cards are in the input chamber 5. The system may utilize the same sensors that indicate the presence of cards in the playing card input to indicate the absence of cards in the chamber. Alternatively, the arm itself may be associated with various sensors to indicate the absence of playing cards in the card input chamber. For example, when there are no cards in the chamber, the arm may continue to rotate clockwise, to a "retracted" position. The arm (as associated sensors or systems that measure the degree of rotation of the arm) may be preprogrammed or trained to recognize the lowest position of the arm with a single card in the chamber. When that position or degree of rotation is subsequently exceeded, a signal will be sent to send the pivot arm to the lowest position (shown in FIG. 2).

As noted above, the end of the arm is provided with a roller, but a low friction surface may also be provided in place of the roller. For example, a smooth, flat, rounded edge with a polymeric coating (e.g., fluorinated polymer, polysiloxane polymer, polyurethane, etc.) can provide a low friction surface that will slide over the playing cards without scratching the cards.

Among the properties and structure of the exemplary pivotally mounted card weight arm with the roller or glide surface thereon are:

1) Essentially downward (towards the cards) free-swinging or controlled arm, with a lower edge gap that extends over edges of playing cards when the arm is elevated;
2) A sensing device identifying the position of the arm along its movement path;
3) The sensed position including sensing of a position of the arm or contact of the arm, indicating the presence, absence or approximate amount (number) of cards in the infeed area;
4) The sensor signaling a processor that commands a motor attached to a belt that can motivate the weighted arm into a contact position, and a retracted position; and
5) An automatic sequence that rotates the weighted arm into a retracted position to allow insertion of additional cards into the shuffler.

Various methods and structures of this technology may be variously described as a card-feeding device used as a subcomponent of a shuffling, card delivery or deck verification device having a card infeed area where cards are stacked to be automatically moved within the device. The device may comprise a card infeed area that supports a stack of cards that has a card support surface; a card-removing system that removes cards individually from the bottom of the stack; a pivoting arm that presses against a card at the top of the stack and at least one sensor that detects at least one of a relative position of the arm within the shuffling device and a presence of a card in the card infeed area. The card-feeding device may also have a motor that rotates the pivoting arm. The rotation of the arm by the motor positions the pivoting arm and applies pressure against the card at the top of the stack to improve frictional contact between a lowest card and the rollers of the card-removing system.

One form of the present invention can be characterized as a card-feeding device that is a component of a card-handling device. The card-handling device can dispense cards, shuffle and dispense cards or verify cards. The card-feeding device has a card infeed area that supports a stack of cards that has a card support surface. In one form of the invention, the card support surface is substantially horizontal. In another form of the invention, the card support surface is sloped. The card-feeding device also includes a card-removing system that removes cards individually from the bottom of the stack. The card-removing system is typically controlled by a microprocessor, and may include a motor, belt drive and at least one roller that comes into frictional contact with the lowermost card in the stack. A pivoting arm is provided. The pivoting arm lowers as cards are dispensed, maintaining a force on cards in the infeed area. The arm presses against a card at the top of the stack in a first position. The card-feeding device also includes at least one sensor that detects at least one of a position of the arm within the shuffling device and a presence of a card in the card infeed area.

Although the pivoting arm may move freely about the pivot point, in one form of the invention, the pivot arm is spring loaded such that a force must be applied to the arm in order to raise the arm high enough to insert cards. In another form of the invention, the card-feeding device includes a computer-controlled drive system. An exemplary drive system includes a motor that rotates the pivoting arm about the pivot point or (pivotal shaft). In a first engaged position, a contact end of the pivot arm applies a downward force to the stack of cards. The drive, the weight of the arm or both applies a downward force to the cards. When the pivot arm is rotated by a motorized drive system, the motor positions the pivoting arm to apply pressure against the card at the top of the stack.

According to a microcomputer-controlled card embodiment, the pivoting arm is positionable in a first card engaged position and a second retracted position. The drive system may move the pivot arm about the pivotal axis in two directions, or may rotate the pivot arm about the pivotal axis in only one direction. The pivot point is spaced apart (horizontally) from the card infeed area so that when in the retracted position, the pivot arm is clear of the card infeed area, so as to not interfere with card loading.

Sensors may be provided to signal the microprocessor to instruct the drive system to rotate the pivot arm. An example of one sensor is a position sensor located on the pivotal shaft. This sensor provides an indication of the position or degree of rotation of the pivoting arm. Each provided sensor is in communication with the processor. The processor may also instruct the motor to alter the position of the pivoting arm upon receiving a sensor signal. Another example of a suitable sensor is a card present sensor located on or beneath the card support surface.

One preferred drive motor is a stepper motor. The stepper motor may rotate in two directions or just in a single direction. When the motor rotates the pivoting arm in a single direction, the pivot arm is capable of moving from a recessed position back into a card-engaging position without interfering with card loading. Preferably, the pivot arm is completely concealed within an interior of the machine when in the recessed position. When in the recessed position, no part of the pivot arm extends into the card infeed area, leaving the area free for typical card loading.

Another aspect of the present invention is a card-feeding device comprising a card infeed area that supports a stack of cards, the card infeed area having a card support surface. The feeding device includes a card-removing system that removes cards from the bottom of the stack of cards, preferably individually. A rotating pivot arm is provided that presses against a card at the top of the stack at a first end, the arm having a second rotating pivot end and a bridging length. The bridging length is elongated and has a recess that is elevated above a line connecting a bottom of the first contact end and a second pivot point on the pivot end when in the card-engaged position. This recess allows for clearance of the cards when the pivot point is mounted closer to the card support surface than an upper surface of the card-feeding device. In one embodiment, the card-contacting end of the pivot arm includes a roller. In one form of the invention, the roller is free-rolling and is formed of an elastomer such as rubber.

A method of shuffling cards is disclosed. The method includes the step of providing cards to be shuffled into a single card infeed as a stack, the stack having a top and bottom surface. The method includes removing cards, one at a time, from the bottom of the stack and moving the removed cards to a shuffling zone. The cards are then shuffled. Examples of known suitable shuffling apparatuses are known in the art and include rack structures, carousel shufflers with multiple compartments, devices that grab groups of cards from a vertical stack, lift the grabbed group and provide a point of insertion, and ejection devices that randomly select an elevation within a stack of cards and eject individual cards out of the stack.

According to the method, the stack of cards inserted into the shuffler is stabilized by a pivoting arm pressing against the top of the stack. When the last card is fed, the microprocessor receives a signal from a sensor and instructs the drive system to automatically move the arm on command. In one embodiment of the method, the processor sends commands to the drive system in response to a received sensor signal. In another form of the invention, a user input is received by the processor, and in turn, the drive system is activated. User commands may result from a sensor or dealer input, as by a button, keyboard, touchscreen or the like.

The pivot arm may include a wheel at the card-contacting end. When the pivot arm is in the engaged position, the wheel contacts the uppermost card in the stack. The sensor may detect the presence or absence of playing cards in the card infeed area. One example of a suitable sensor is an optical sensor. The sensor signals received by the processor may also be from a sensor that senses the position of a rotational shaft of the pivot arm.

Another aspect of the invention is a card feed system, comprising a card infeed area with a card support surface. The system includes a card removal system capable of removing cards individually from a bottom of a stack of cards. A rotating pivot arm is provided that in a first engaged position applies a downward force to a stack of cards being fed and in a second recessed position is free of the card infeed area. The card feed system may advantageously be used as a card feeder for a card-shuffling mechanism, a card delivery system such as a mechanical card shoe, a deck verification device, a card sorter or combination shuffler/hand-forming device.

Although specific examples, sequences and steps have been clearly described, variations and alternatives would be apparent to those skilled in the art and are intended to be within the scope of the invention claimed.

What is claimed is:

1. A card-feeding device for a card-handling device, comprising:

a card infeed area having a card support surface for supporting a single stack of cards;

a card-removing system for removing cards individually from the bottom of the stack;

a pivoting arm configured and positioned to press against an uppermost card in a stack of cards disposed in the card infeed area, the pivoting arm having a pivot point that is positioned vertically below an upper edge of the card infeed area; and at least one sensor for detecting at least one of a position of the arm within the shuffling device and a presence of a card in the card infeed area.

2. The card-feeding device of claim 1, further comprising a motor operatively coupled to the pivoting arm for rotating the pivoting arm such that an end of the pivoting arm opposite the pivot point stays in contact with the uppermost card in the stack as cards are removed from the card infeed area.

3. The card-feeding device of claim 2, wherein rotation of the arm by the motor positions the pivoting arm to apply pressure against the card at the top of the stack.

4. The card-feeding device of claim 2, wherein the at least one sensor indicates the position or degree of rotation of the pivoting arm.

5. The card-feeding device of claim 2, wherein a processor is in communication with the at least one sensor.

6. The card-feeding device of claim 2, wherein the motor is a stepper motor.

7. The card-feeding device of claim 6, wherein the motor is configured to rotate in only one direction.

8. The card-feeding device of claim 1, wherein the pivoting arm is positionable in a card engaged position and a retracted position.

9. The card-feeding device of claim 1, wherein a processor is in communication with the at least one sensor.

10. The card-feeding device of claim 9, wherein the processor is in communication with the at least one sensor, and wherein the processor is programmed to actuate the motor to alter the position of the pivoting arm.

11. The card-feeding device of claim 1, wherein the pivoting arm is configured to be positioned in a retracted position wherein the pivoting arm is removed from the card infeed area.

12. A method of shuffling cards comprising:

providing cards to be shuffled into a single card infeed area of a card shuffling apparatus, the card infeed area accessible from an upper surface of the card shuffling apparatus as a stack with a top and bottom;

removing cards one at a time from the bottom of the stack and moving the removed cards to a shuffling zone;

shuffling the cards; and stabilizing the stack of cards with a motor rotating a portion of a pivoting arm into contact with a portion of the stack of cards, the pivoting aim having a pivot point that is positioned vertically below an uppermost edge of the card infeed area, and subsequently removing the arm from the portion of the stack of cards with the motor.

13. The method of claim 12, further comprising moving the pivoting arm in response to a signal from a sensor.

14. The method of claim 13, further comprising detecting the presence or absence of playing cards in the card infeed area with the sensor.

15. The method of claim 13, further comprising detecting at least one of a degree of rotation of the pivoting arm and pressure by the pivoting arm against playing cards in the infeed area with the sensor.

16. The method of claim 12, further comprising moving the pivoting arm in response to a user input.

17. The method of claim 12, further comprising contacting the top of the stack of cards with a wheel carried by the arm.

18. A card feed system, comprising:

a card infeed area with a card support surface, the card infeed area accessible from an upper surface of the card feed system;

a card removal system capable of removing cards individually from a bottom of a stack of cards; and a rotating pivot arm configured, in a first engaged position, to apply a downward force to a stack of cards in the card infeed area and, in a second recessed position, to be removed from the card infeed area, the pivoting arm having a pivot point that is positioned vertically below an upper edge of the card infeed area.

19. The card feed system of claim 18, and further comprising a card-shuffling system.

* * * * *

UNITED STATES PATENT AND TRADEMARK OFFICE

CERTIFICATE OF CORRECTION

PATENT NO. : 8,662,500 B2
APPLICATION NO. : 13/741236
DATED : March 4, 2014
INVENTOR(S) : Ronald R. Swanson It is certified that error appears in the above-identified patent and that said Letters Patent is hereby corrected as shown below:

In the claims:

CLAIM 12, COLUMN 9, LINE 4, change "pivoting aim" to --pivoting arm--

Signed and Sealed this
Thirteenth Day of October, 2015

Michelle K. Lee

Michelle K. Lee
*Director of the United States Patent and Trademark Office*